US005533491A

United States Patent [19]

Gras et al.

[11] Patent Number: 5,533,491

[45] Date of Patent: Jul. 9, 1996

[54] CONTROL SYSTEM FOR METERING FUEL TO AN INTERNAL COMBUSTION ENGINE

[75] Inventors: Jürgen Gras, Bietigheim-Bissingen; Siegfried Hertzler, Bolanden; Jan-Tian Tjoa, Ludwigsburg, all of Germany

[73] Assignee: Robert Bosch GmbH, Stuttgart, Germany

[21] Appl. No.: 341,595

[22] PCT Filed: Feb. 19, 1994

[86] PCT No.: PCT/DE94/00175

§ 371 Date: Nov. 21, 1994

§ 102(e) Date: Nov. 21, 1994

[87] PCT Pub. No.: WO94/21909

PCT Pub. Date: Sep. 29, 1994

[30] Foreign Application Priority Data

Mar. 19, 1993 [DE] Germany ..... 43 08 813.9

[51] Int. Cl.[6] ..... F02D 41/00

[52] U.S. Cl. ..... 123/676

[58] Field of Search ..... 123/676, 678

[56] References Cited

U.S. PATENT DOCUMENTS

| | | | |
|---|---|---|---|
| 3,918,257 | 11/1975 | Hirose et al. | 123/676 |
| 4,357,922 | 11/1982 | Rosenzopf et al. | 123/676 |
| 4,392,470 | 7/1983 | Günther et al. | 123/676 |
| 4,437,445 | 3/1984 | Takahashi et al. | 123/676 |
| 4,879,986 | 11/1989 | Sakamoto | 123/676 |
| 4,930,480 | 6/1990 | Noyori | 123/676 |
| 5,131,371 | 7/1992 | Wahl et al. | 123/676 |

FOREIGN PATENT DOCUMENTS

| | | | |
|---|---|---|---|
| 2311936 | 12/1976 | France | 123/676 |
| 3520050 | 12/1985 | Germany | 123/626 |
| 58-72628 | 4/1983 | Japan | 123/676 |
| 59-196932 | 11/1984 | Japan | 123/676 |

*Primary Examiner*—Raymond A. Nelli
*Attorney, Agent, or Firm*—Walter Ottesen

[57] ABSTRACT

A control system for metering fuel to an internal combustion engine is proposed. Time duration values TVO and threshold values are preferably pregiven for the engine temperature in the idle case XOLL and in the non-idle case XONLL in dependence upon the start temperature. In a preferred embodiment, and after a start temperature dependent time has elapsed, an inquiry is made as to whether the engine temperature has already reached values which correspond to stored threshold values for the idle case and for the non-idle case and a switchover from open-loop operation to closed-loop operation of the lambda control takes place in dependence thereupon.

12 Claims, 3 Drawing Sheets

CONTROL SYSTEM FOR METERING FUEL TO AN INTERNAL COMBUSTION ENGINE

BACKGROUND OF THE INVENTION

The invention proceeds from a control system for the metering of fuel to an internal combustion engine. A method as well as an arrangement for operating a fuel supply arrangement having a lambda control is known from U.S. Pat. No. 4,357,922. There, the lambda control is switched on when, in addition to the operational readiness of the probe, a specific engine temperature has been reached. The magnitude of this temperature is listed as "preferably 50° to 85°". Furthermore, U.S. Pat. No. 4,392,470 discloses a control arrangement for the composition of the operating mixture which enters the internal combustion engine for combustion. This document teaches that the lambda control is switched on for two different exhaust gas temperatures, namely, in dependence upon whether there is an idle state or not.

It has been shown that these known methods cannot operate optimally in all operating states. It is therefore an object of the invention to provide, based on this state of the art, a control system for metering fuel to an internal combustion engine which, above all, provides a greater flexibility in comparison to the methods known up to now.

SUMMARY OF THE INVENTION

The control system according to the invention affords the advantage compared to the known systems that, in the context of an optimization for good driving performance of the engine, the lambda control is switched on at a very early time point and therefore the emission of toxic substances is further reduced.

BRIEF DESCRIPTION OF THE DRAWINGS

An embodiment of the invention (with alternate solutions) is shown in the drawing and is described in greater detail in the following.

DESCRIPTION OF THE PREFERRED EMBODIMENTS OF THE INVENTION

Figure 1:
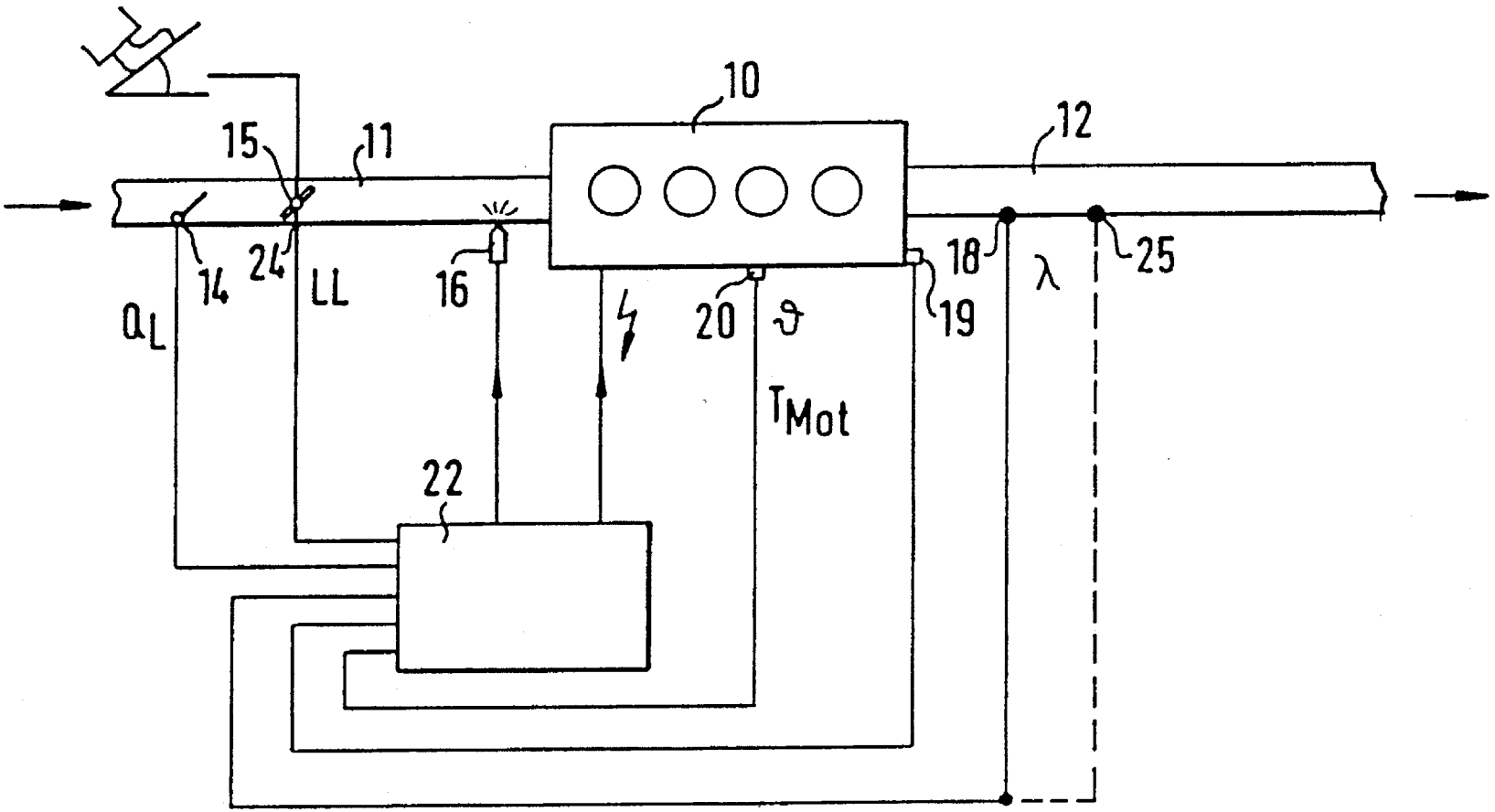
FIG. 1 shows an overview diagram of a control system of an internal combustion engine.

FIG. 1 shows, in the context of an overview diagram, the system components and engine variables which are essential in combination with the present invention. The internal combustion engine itself is identified by reference numeral 10, its intake pipe by 11 and its exhaust gas pipe by 12. The following are disposed one behind the other in the flow direction in the intake pipe: an air mass or air quantity sensor 14, a throttle flap 15 and an injection valve 16. A lambda probe 18 is mounted in the exhaust gas pipe. The lambda probe 18 reacts to the presence of oxygen in the exhaust gas in a manner known per se after it reaches its operating temperature. Additionally, an exhaust gas temperature sensor 25 can be mounted in the exhaust gas pipe.

A rpm sensor 19 and a temperature sensor 20 are provided for the internal combustion engine 10. A control apparatus 22 receives input signals from the following: a throttle flap sensor 24 which is operatively connected to the throttle flap 15; the air quantity sensor 14; the lambda probe 18; the exhaust gas temperature sensor which can be provided as an option; and, the two sensors 19 and 20 for rpm and the temperature TMot of the internal combustion engine. The exhaust gas temperature as well as the temperature of the catalytic converter can also be computed within the control apparatus as a model from other engine variables of the engine. The control apparatus 22 provides at least the following at its output end: an injection signal for the injection valves 16 of which there is at least one and ignition signals for the spark plugs of the engine which are not specifically shown.

The structure of a control system shown in FIG. 1 is known for an internal combustion engine as is its operation. The control apparatus 22 forms pulsewidth modulated signals for the at least one injection valve 16 as well as the ignition signals for the individual spark plugs. These pulsewidth modulated signals are formed in dependence upon load and rpm as well as additional engine variables such as engine temperature and a signal from the throttle flap sensor 24. A control of the fuel metering to a specific lambda value, preferably lambda=1, takes place in the operating state wherein both the engine and lambda probe are warm. The present invention sets forth measures for obtaining the most optimal results with respect to a fastest possible utilization of lambda control in the sense of providing an exhaust gas as free as possible of toxic materials. The state of the art described above is advanced further in this respect.

Figure 2:
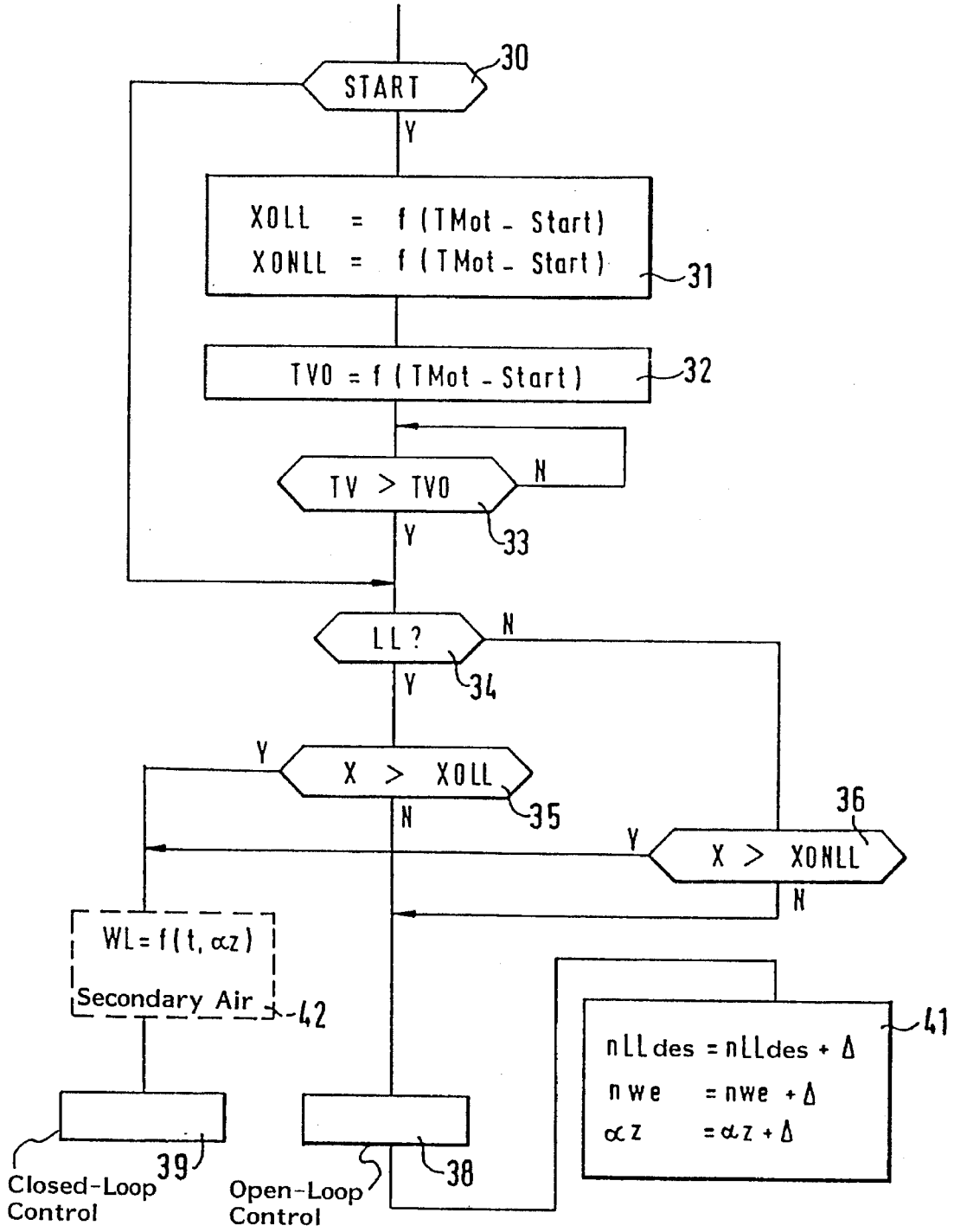
FIG. 2 shows a flowchart for determining the switch-on point of the lambda control.

FIG. 2 shows a flowchart for determining the start point of the lambda control based on a control operation initiated directly after a start operation. For this purpose, the inquiry is made as to whether a start operation is present and this inquiry is identified by reference numeral 30. If a start operation is present, then two threshold values are read out of next-following characteristic lines 31 in dependence upon the engine temperature TMot-start (start temperature) which is present at the start time point.

The two threshold values are XOLL for the idle case (LL) and XONLL for the case where idle is not present. From a next-following characteristic line 32, a time duration value TVO is read out and is likewise dependent upon the engine temperature TMot-start present at the start time point. The next-following inquiry 33 determines whether the pregiven time duration TVO has elapsed since the start time point.

If this is the case, then, in the following (inquiry 34) a statement is made as to whether idle is present or not. In the case of idle operation, the next-following inquiry 35 becomes effective where a determination is made whether or not a specific value X has already reached the threshold value XOLL read out of the characteristic line 31. Correspondingly, an inquiry 36 is provided where a determination is made as to whether the value X has reached the threshold value XONLL in the case of driving operation, that is, non-idle operation. If the threshold values in one of the two inquiries 35 and 36 have not yet been reached, then the system continues in the open-loop control operation (block 38), otherwise, a transfer to closed-loop control operation (block 39) takes place. The additional blocks 41 and 42 will be explained later.

In the context of a simplified embodiment of the invention, it is also possible to simply use a load-independent threshold value in lieu of the two threshold values XOLL or XONLL. It is also possible to utilize the pregiven time duration together or alternatively to the at least one threshold value of a magnitude, which characterizes the operating duration of the engine, as a switch-on criterion for the lambda control.

Furthermore, it is also possible to utilize a quantity characterizing the operating temperature of the catalytic converter as a switch-on criterion. This quantity can be computed as a model from operating variables of the engine.

Figure 3:
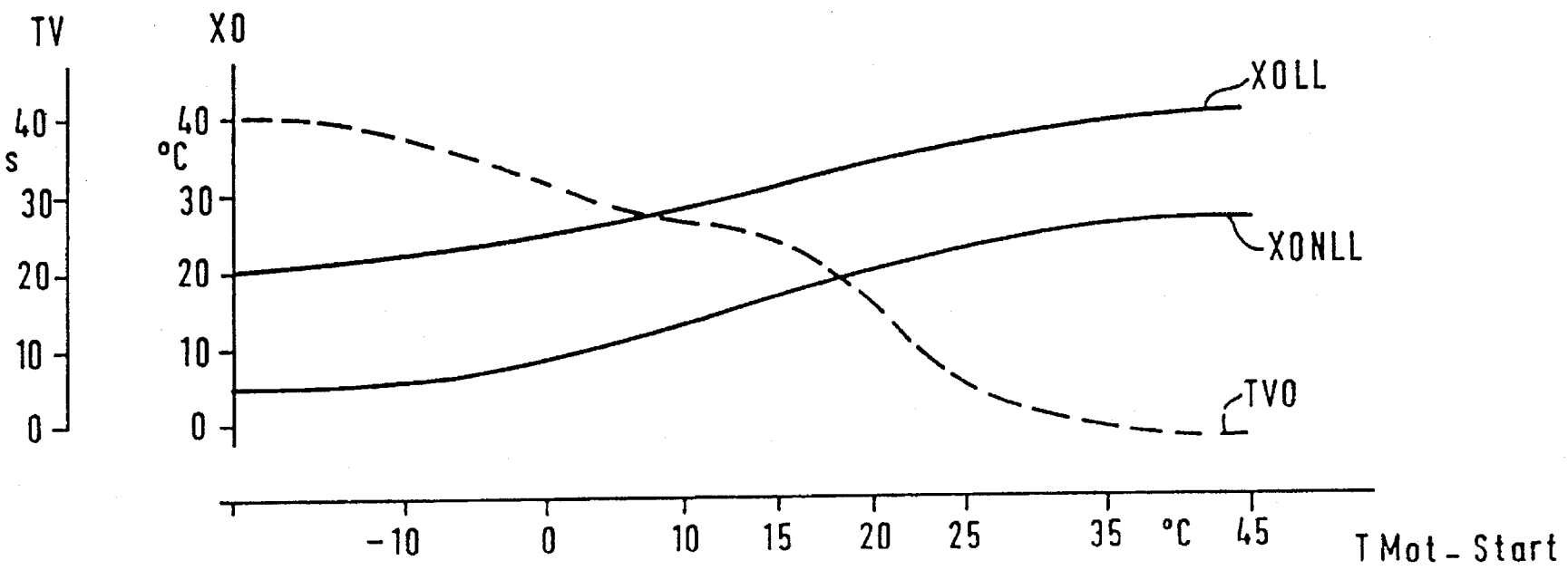
FIG. 3 shows an example of values in combination with the flowchart of FIG. 2.

The operation of the flowchart of FIG. 2 is explained suitably with respect to the signal traces shown in FIG. 3. In FIG. 3, the temperature of the engine is plotted along the abscissa at the time point of the start (start temperature, TMot-start). The time duration TV and a value XO are plotted along the ordinate. Time duration values and the trace thereof are presented by the broken line. Furthermore, two curves with solid lines are plotted wherein the value XOLL identifies a temperature trace in the idle case and XONLL identifies a temperature trace in the non-idle case.

It is emphasized that the curve traces presented serve only as an example and the values in a special system have to be orientated to appropriate values for a specific engine type.

As an essential statement of FIG. 3, it should be noted that different engine temperatures XO for the case of idle (LL) and non-idle (NLL) must be reached at individual temperature values at the start time point of the engine (TMot-start) in order to activate the lambda control. The values of the two curves XOLL and XONLL originate from the characteristic curves in block 31 of the flowchart of FIG. 2.

Correspondingly, the time duration values TVO, which can be seen in FIG. 3, are read out of the characteristic line 32 of the flowchart of FIG. 2. From this, it can be seen that the pregiven time duration is selected to be less with increasing temperature of the engine at the start time point.

The operation of the control system according to the invention is made clear from FIG. 2 in combination with the curve traces of FIG. 3.

If the start case is present, then the value, which is applicable for a specific start temperature, is read out for the idle case XOLL as well as the value for the non-idle case XONNL in correspondence to block 31 from two characteristic lines. Thereafter, and in correspondence to block 32, a value for a time duration TVO, which is likewise dependent upon the start temperature, is read out in correspondence to block 32. After this time duration has elapsed, a clarification of the question is made in inquiry block 34 as to whether or not idle is present at the time point of the corresponding program runthrough.

If idle is present but a threshold value XOLL is not yet satisfied, the open-loop control operation of block 38 is maintained. A corresponding performance takes place if a threshold value XONLL has not yet been reached in the non-idle case. Otherwise, a transfer to closed-loop control by means of block 39 takes place.

With X, in combination with the characteristic field values XOLL and XONLL, it is intended to make clear that different quantities can be inserted for these values. The temperature is the most essential quantity to be mentioned here. This means that temperature threshold values for both the idle case and the non-idle case can be read out of block 31 as a function of the start temperature and, in the inquiries 35 and 36, a determination is made whether the instantaneous temperature measurement value has already reached the two threshold values for the idle operation and the non-idle operation. A transfer from open-loop control to closed-loop control takes place only when these threshold values are exceeded in the idle case and in the non-idle case.

As a further variable to be measured in lieu of TMot, a signal can be used which indirectly or directly provides the energy conversion in the engine since the start. This means that, indirectly or directly at least one of the following variables can be detected:

the number of ignitions having occurred since the start;

the sum of the air masses drawn in by suction since the start;

the sum of the fuel masses, especially the sum of the outputted injection times, supplied since the start;

integral of the throttle flap angle which likewise corresponds to a summed load signal;

the catalytic converter temperature which can be computed as a model from variables of the engine. A conclusion can be drawn, utilizing a model, as to the temperature of the catalytic converter and therefore as to the operational readiness of the catalytic converter with the aid of the exhaust gas temperature which can be measured, for example, with the aid of the exhaust gas temperature sensor 25 or can be derived in a manner known per se from the internal resistance of the lambda probe 18.

Block 41 of FIG. 2 emphasizes different measures during open-loop operation (block 38). It has proven especially purposeful to increase the idle rpm desired value by a specific increment in the warm-up phase. In addition, alternatively or supplementary, the resume rpm to enable the fuel metering after fuel cutoff in overrun operation can be inhibited or the ignition can be retarded.

Block 42 in the flowchart of FIG. 2 clarifies the possibility (when switching on the closed-loop control or while delaying its effectiveness) to control a warm-up enriching factor WL in dependence upon time and/or in dependence upon ignition by means of a ramp or, alternatively, or supplementary, in the case of the possibility of a secondary input of air, to first switch off this secondary air input and only thereafter to allow the closed-loop control in block 39 to become effective with a selectable delay.

What is claimed is:

1. A control system for metering fuel into an internal combustion engine in dependence upon engine temperature, said engine having an exhaust gas pipe and said control system comprising:

(a) an oxygen sensor mounted in said exhaust gas pipe to provide an output signal indicative of exhaust gas constituents;

(b) sensor means for detecting said preselected engine temperature;

(c) means for closed-loop controlling a metering of fuel in dependence upon said output signal of said oxygen sensor;

(d) switchover means for switching between open-loop operation and closed-loop operation after a predetermined time duration which becomes less with an increasing value of said engine temperature at engine start;

(e) means for determining said predetermined time duration as a function of said engine temperature at engine start; and, (f) means for implementing said switchover to closed-loop operation when said predetermined time duration has elapsed.

2. The control system of claim 1, wherein: up to the switch-on time of the closed-loop control, at least one of the following measures is carried out: increase of the idle desired rpm; increase of the resume rpm for enabling the metering of fuel after fuel cutoff in overrun operation; and, retarding ignition.

3. The control system of claim 2, wherein: in combination with the transfer to closed-loop control operation, at least one of the following measures becomes effective: controlling a warm-running enrichment factor in dependence upon one of the following: time and ignition via a ramp; and, delaying start of said closed-loop control until secondary air input is switched off.

4. The control system of claim 1, wherein: at least for two different load states, different threshold values are selected for said engine temperature characterizing the operation duration of said engine; and, said switchover means includes a means for switching over said open-loop control to said closed-loop control when at least one of the following occurs: said engine temperature has reached the load-dependent threshold value for a load state then present and the pregiven time duration has elapsed.

5. A control system for metering fuel into an internal combustion engine in dependence upon preselected engine variables, said engine having an exhaust gas pipe and a catalytic converter through which exhaust gas passes and said control system comprising:

(a) an oxygen sensor mounted in said exhaust gas pipe to provide an output signal indicative of exhaust gas constituents;

(b) means for closed-loop controlling a metering of fuel in dependence upon said output signal of said oxygen sensor;

(c) said preselected engine variables consisting of:

(c1) ignitions occurring since said engine has started;

(c2) mass of air inducted into said engine since said engine has started;

(c3) mass of fuel supplied to said engine since said engine has started;

(c4) number of durations of fuel injections since said engine has started;

(c5) integral of throttle flap angle as a function of time since said engine has started;

(c6) integral of air pressure in the intake pipe of said engine as a function of time since said engine has started;

(c7) temperature of said exhaust gas; and, (c8) temperature of said catalytic converter;

(d) sensor means for detecting at least one of said preselected engine variables;

(e) means for determining a threshold value of said one preselected engine variable;

(f) switchover means for switching between open-loop operation and said closed-loop operation after said threshold value is exceeded; and, (g) means for implementing said switchover to closed-loop operation when said threshold value is exceeded.

6. The control system of claim 5, wherein: up to the switch-on time of the closed-loop control, at least one of the following measures is carried out: increase of the idle desired rpm; increase of the resume rpm for enabling the metering of fuel after fuel cutoff in overrun operation; and, retarding ignition.

7. The control system of claim 6, wherein: in combination with the transfer to closed-loop control operation, at least one of the following measures becomes effective: controlling a warm-running enrichment factor in dependence upon one of the following: time and ignition via a ramp; and, delaying start of said closed-loop control until secondary air input is switched off.

8. The control system of claim 5, wherein: at least for two different load states, different threshold values are selected for said one engine variable characterizing the operation duration of the engine; and, said switchover means includes a means for switching over said open-loop control to said closed-loop control when at least one of the following occurs: said one engine variable has reached the load-dependent threshold value for a load state then present and the pregiven time duration has elapsed.

9. A control system for metering fuel into an internal combustion engine in dependence upon preselected engine variables, said engine having an exhaust gas pipe and a catalytic converter through which exhaust gas passes and said control system comprising:

(a) an oxygen sensor mounted in said exhaust gas pipe to provide an output signal indicative of exhaust gas constituents;

(b) means for closed-loop controlling a metering of fuel in dependence upon said output signal of said oxygen sensor;

(c) said preselected engine variables including:

(c1) ignitions occurring since said engine has started;

(c2) mass of air inducted into said engine since said engine has started;

(c3) mass of fuel supplied to said engine since said engine has started;

(c4) number of durations of fuel injections since said engine has started;

(c5) integral of throttle flap angle as a function of time since said engine has started;

(c6) integral of air pressure in the intake pipe of said engine as a function of time since said engine has started;

(c7) temperature of said exhaust gas; and, (c8) temperature of said catalytic converter;

(d) sensor means for detecting at least one of said preselected engine variables;

(e) means for determining a threshold value of said one preselected engine variable;

(f) means for determining a predetermined time duration as a function of engine temperature at engine start;

(g) switchover means for switching between open-loop operation and said closed-loop operation after said threshold value is exceeded and said predetermined time duration has elapsed; and, (h) means for implementing said switchover to closed-loop operation when said threshold value is exceeded and said predetermined time duration has elapsed.

10. The control system of claim 9, wherein: up to the switch-on time of the closed-loop control, at least one of the following measures is carried out: increase of the idle desired rpm; increase of the resume rpm for enabling the metering of fuel after fuel cutoff in overrun operation; and, retarding ignition.

11. The control system of claim 10, wherein: in combination with the transfer to closed-loop control operation, at least one of the following measures becomes effective: controlling a warm-running enrichment factor in dependence upon one of the following: time and ignition via a ramp; and, delaying start of said closed-loop control until secondary air input is switched off.

12. The control system of claim 9, wherein: at least for two different load states, different threshold values are selected for said one engine variable characterizing the operation duration of the engine; and, said switchover means includes a means for switching over said open-loop control to said closed-loop control when at least one of the following occurs: said one engine variable has reached the load-dependent threshold value for a load state then present and the pregiven time duration has elapsed.

* * * * *